United States Patent [19]

Rickey

[11] Patent Number: 5,076,579

[45] Date of Patent: Dec. 31, 1991

[54] FOLDING EXERCISE DEVICE

[76] Inventor: Robert B. Rickey, P.O. Box 280969, Memphis, Tenn. 38168

[21] Appl. No.: 577,290

[22] Filed: Sep. 4, 1990

[51] Int. Cl.[5] ..... A63B 21/00

[52] U.S. Cl. ..... 272/144; 272/120

[58] Field of Search ..... 272/144, 120, 122, 123, 272/128, 127, 134, 131, 145, 146, 93; 128/870

[56] References Cited

U.S. PATENT DOCUMENTS

| | | | |
|---|---|---|---|
| 3,315,667 | 4/1967 | Yoder | 272/144 X |
| 4,324,399 | 4/1982 | Rickey | 272/144 |
| 4,531,730 | 7/1985 | Chenera | 272/144 |
| 4,609,192 | 9/1986 | Bratcher | 272/144 |

FOREIGN PATENT DOCUMENTS

| | | | |
|---|---|---|---|
| 2491341 | 4/1982 | France | 272/144 |

*Primary Examiner*—Richard J. Apley
*Assistant Examiner*—D. F. Crosby
*Attorney, Agent, or Firm*—Walker & McKenzie

[57] ABSTRACT

A foldable exercise device including a board member having a planar top surface for supporting the user in any of several exercising positions; first and second rollers for runningly ridably supporting the board member in a horizontal disposition; structure for dividing and separating the board member into first and second end members; and hinge structure for hingably joining the first and second end members of the board member together and for allowing the board member to be folded between an opened position and a closed position.

6 Claims, 2 Drawing Sheets

FOLDING EXERCISE DEVICE

BACKGROUND OF THE INVENTION

1. Field of the Invention

The present invention relates, in general, to exercising devices and, more specifically, to a folding exercise device.

2. Information Disclosure Statement

Numerous exercises devices have been developed for aiding an exerciser in performing one or more specific exercises such as sit-ups, leg lifts, roll outs, reverse roll outs, etc. Some of these devices are portable and can be folded for easy storage, etc.

My prior United States patent, Rickey, U.S. Pat. No. 4,324,399, filed May 27, 1980, issued Apr. 13, 1982, discloses an exercising device including an oblong board member having a size to comfortably support the user's torso and head, fore and aft roller means for runningly ridably supporting the board member in a horizontal disposition, and track means for supportable engagement with the roller means. The exercising device disclosed in the U.S. Pat. No. 4,324,399 patent provides a single device that aids an exerciser in performing sit-ups, leg lifts, roll outs, reverse roll outs, etc.

However, nothing in the prior art discloses or suggests the present invention. More specifically, nothing in the prior art discloses or suggests a foldable exercise device including a board member having a planar top surface for supporting the user in any of several exercising positions; first and second roller means for runningly ridably supporting the board member in a horizontal disposition; separating means for dividing and separating the board member into first and second end members; and hinge means for hingably joining the first and second end members of the board member together and for allowing the board member to be folded between an opened position and a closed position.

SUMMARY OF THE INVENTION

The present invention is directed toward providing an improved exercise device. The concept of the present invention is to provide a folding, portable exercise device which allows an exerciser to perform a variety of exercise including sit ups, leg lifts, roll outs, reverse roll outs, bench-stepping, etc.

The folding exercise device of the present invention includes, in general, a board member having a planar top surface for supporting the user in any of several exercising positions; first and second roller means for runningly ridably supporting the board member in a horizontal disposition; separating means for dividing and separating the board member into first and second end members; and hinge means for hingably joining the first and second end members of the board member together and for allowing the board member to be folded between an opened position and a closed position.

Objectives of the present invention include providing an exercise device that provides all the benefits of the exercising device disclosed in the U.S. Pat. No. 4,324,399 and which, in addition, is extremely portable; can be stored in a minimum of space; serves as storage space for auxiliary items including combination dumb bells/rollers, ankle weights, wrist weights, shoes and/or foot weights, removable legs, etc.; and can be used for so-called "bench-stepping" exercises and the like.

BRIEF DESCRIPTION OF THE DRAWINGS

FIG. 6 is a side elevational view of the folding exercise device of the present invention shown in a first in-use position, i.e., for use as an aid for roll out and reverse roll out exercises, and the like.

FIG. 7 is a side elevational view of the folding exercise device of the present invention shown in a second in-use position, i.e., for use as an aid for sit ups and leg lift exercises and the like.

DESCRIPTION OF THE PREFERRED EMBODIMENT

Figure 1:
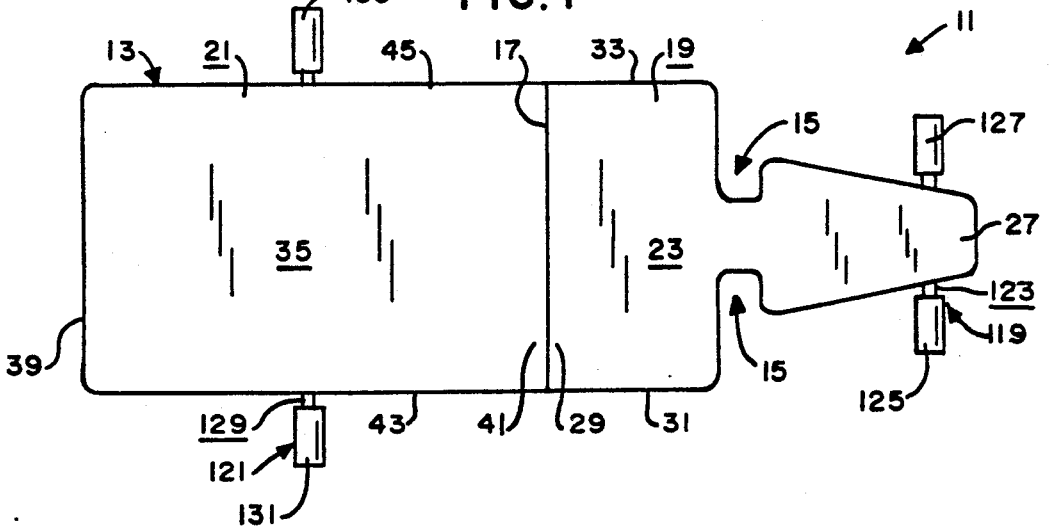
FIG. 1 is a top plan view of the folding exercise device of the present invention shown in an opened position.
Figure 2:
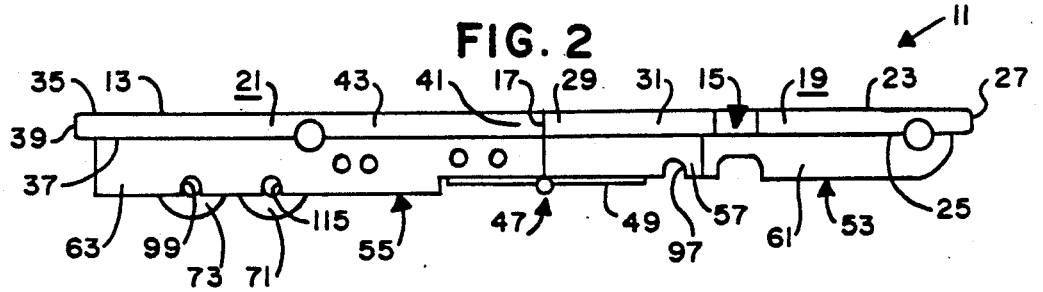
FIG. 2 is a side elevational view of FIG. 1.

The folding exercise device 11 of the present invention is an improvement of my exercise device that was fully disclosed in U.S. Pat. No. 4,324,399, filed May 27, 1980 and issued Apr. 13, 1982. Reference should be made to the 4,324,399 patent for a more complete disclosure and understanding of the basic structure and operation.

The folding exercise device 11 is intended for exercising certain muscles of the user as the user selectively performs various exercises in conjunction with the device 11. It should be understood that while the device 11 will be disclosed in a preferred embodiment, an important feature thereof is the fact that it may be arranged in several different configurations for performing several different exercises, etc.

The device 11 includes a board member 13. The board member 13 is preferably substantially the same shape and size as the board member of the U.S. Pat. No. 4,324,399. Thus, the board member 13 preferably includes an oblong, planar face surface for supporting the user in various positions. The board member 13 may be constructed in various manners and out of various materials as will now be apparent to those skilled in the art. Thus, for example, the board member 13 may include a rigid plywood base, resilient foam padding, and a vinyl cover, etc., as will now be apparent to those skilled in the art. While the specific shape and size of the board member 13 may vary, a pair of opposed notches 15 are preferably provided therein toward one end thereof for reasons clearly stated in the U.S. Pat. No. 4,324,399.

The improvement of the present invention includes separating means 17 for dividing and separating the board member 13 into a first end member 19 and a second end member 21. Each end member 19, 21 is preferably substantially the same in length whereby the separating means divides the board member 13 into substantially equal halves. The first end member 19 of the board member 13 has a substantially planar face surface 23, a back surface 25, a distal end 27, a proximal end 29, a first side 31, and a second side 33. The second end member 21 of the board member 13 has a substantially planar face surface 35, a back surface 37, a distal end 39, a proximal end 41, a first side 43, and a second side 45. The separating means 17 preferably consist of a cut or other space along the proximal end 29, 41 of each end member 19, 21 for dividing the board member 13 into the separate first and second end members 19, 21. More specifically, the board member 13 of the improved folding exercise device 11 is preferably constructed as a two-piece unit with the first and second end members 19, 21 constructed separately from one another as will now be apparent to those skilled in the art.

Figure 3:
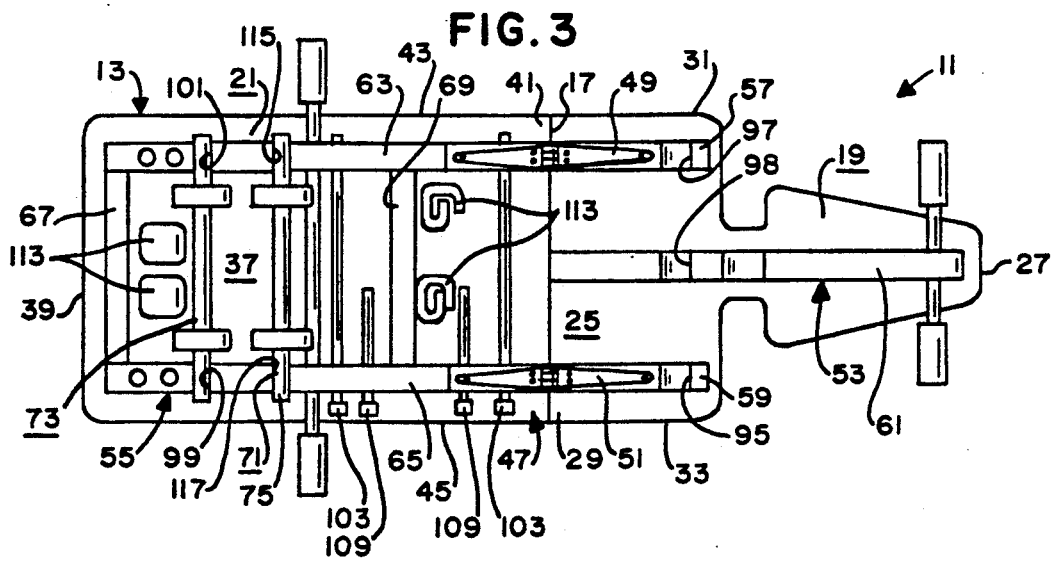
FIG. 3 is a bottom view of FIG. 1.
Figure 4:
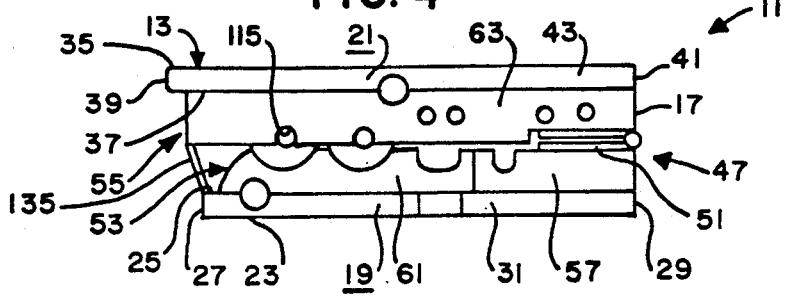
FIG. 4 is a side elevational view of the folding exercise device of the present invention shown in a folded, horizontally stored position.
Figure 5:
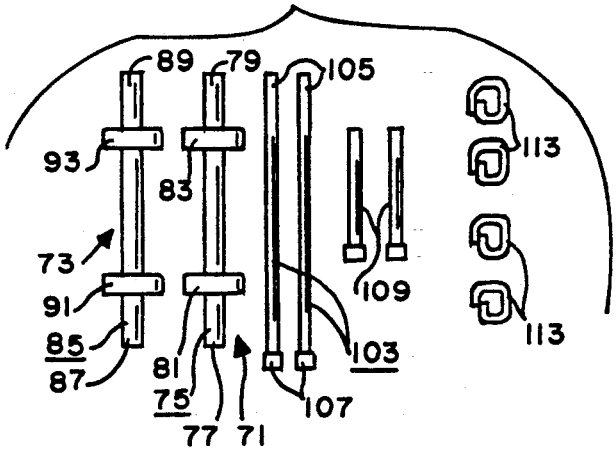
FIG. 5 is an exploded view of certain components of the folding exercise device of the present invention.
Figure 6:
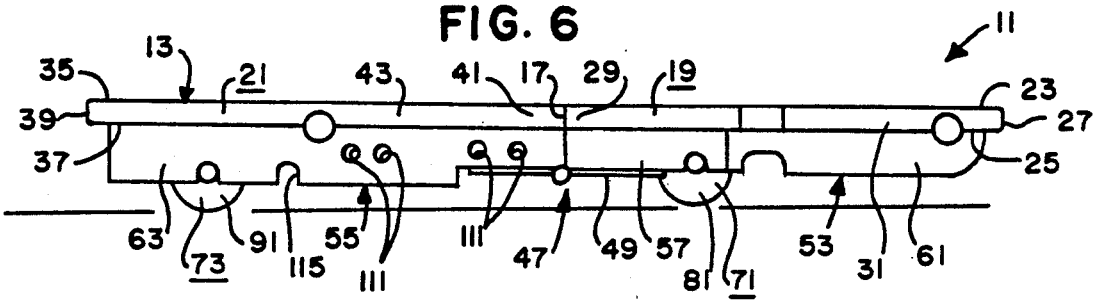

The improvement of the present invention includes hinge means 47 for hingably joining the first and second end members 19, 21 of the board member 13 together and for allowing the board member 13 to be folded between an opened position as shown in FIGS. 1, 2, 3, 6, and 7, and a closed or folded position as shown in FIGS. 4 and 5. The hinge means 47 preferably includes a first hinge member 49 extending between the proximal ends 29, 41 of the first and second end members 19, 21 substantially adjacent the first sides 31, 43 thereof. The hinge means 47 preferably includes a second hinge member 51 extending between the proximal ends 29, 41 of the first and second end members 19, 21 substantially adjacent the second sides 33, 45 thereof. Each hinge member 49, 51 preferably consists of a typical, off-the-shelf butt hinge or the like as will now be apparent to those skilled in the art.

The device 11 preferably includes a first frame 53 fixedly attached to the back surface 25 of the first end member 19 and a second frame 55 fixedly attached to the back surface 37 of the second end member 21.

The first frame 53 preferably includes an elongated first block member 57 fixedly attached to the back surface 25 of the first end member 19 adjacent the first side 31 thereof, an elongated second block member 59 fixedly attached to the back surface 25 of the first end member 19 adjacent the second side 33 thereof, and an elongated third block member 61 fixedly attached to the back surface 25 of the first end member 19 intermediate the first and second sides 31, 33 thereof. The first and second block members 57, 59 preferably extend from the proximal end 29 of the first end member 19 to a point adjacent the notches 15 as clearly shown in FIG. 3. The third block member 61 preferably extends from the proximal end 29 of the first end member 19 to a point adjacent the distal end 27 of the first end member 19 as clearly shown in FIG. 3. The block members 57, 59, 61 may be of any specific construction now apparent to those skilled in the art. In the preferred embodiment of the folding exercise device 11, the blocks 57, 59, 61 consist of various lengths of common 2-by-4 lumber screwed or otherwise fixedly attached to the bottom of the board member 13.

The second frame 55 preferably includes an elongated first block member 63 fixedly attached to the back surface 37 of the second end member 21 adjacent the first side 43 thereof, an elongated second block member 65 fixedly attached to the back surface 37 of the second end member 21 adjacent the second side 45 thereof, an elongated third block member 67 fixedly attached to the back surface 37 of the second end member 21 adjacent the distal end 39 thereof and extending between the first and second block members 63, 65, and an elongated fourth block member 69 fixedly attached to the back surface 37 of the second end member 21 at a point between the distal and proximal ends 39, 41 thereof and extending between the first and second block members 63, 65 as clearly shown in FIG. 3. The first and second block members 63, 65 preferably extend from the distal end 39 of the second end member 21 to the proximal end 41 of the second end member 21. The block members 63, 65, 67, 69 may be of any specific construction now apparent to those skilled in the art. In the preferred embodiment of the folding exercise device 11, the blocks 63, 65, 67, 69 consist of various lengths of common 2-by-4 lumber screwed or otherwise fixedly attached to the bottom of the board member 13.

The first hinge member 49 is preferably attached to the first block member 57 of the first frame 53 and the first block member 63 of the second frame 55 by screws or the like as clearly shown in FIG. 3. The second hinge member 51 is preferably attached to the second block member 59 of the first frame 53 and the second block member 65 of the second frame 55 by screws or the like as clearly shown in FIG. 3.

The device 1 includes various accessories for exercise use. Thus, the device 11 includes a first roller means 71 and a second roller means 73 for runningly ridably supporting the board member 13 in a horizontal disposition for reasons and in a manner as fully disclosed in the U.S. Pat. No. 4,324,399. Thus, the first roller means 71 preferably includes an elongated axle 75 having a first end 77 and a second end 79, a first wheel 81 attached to the axle 75 adjacent the first end 77, and a second wheel 83 attached to the axle 75 adjacent the second end 79. The second roller means 73 is preferably a mirror image of the first roller means 71 and preferably includes an elongated axle 85 having a first end 87 and a second end 89, a first wheel 91 attached to the axle 85 adjacent the first end 87, and a second wheel 93 attached to the axle 85 adjacent the second end 89. The roller means 71, 73 may be constructed so as to weigh a certain amount to allow them to be additionally used as hand weights or dumb bells in any manner now apparent to those skilled in the art. Thus, the wheels 81, 83, 91, 93 may be constructed out of a substantially heavy metal or the like in any manner now apparent to those skilled in the art.

The first block member 57 of the first frame 53 preferably has a notch 95 therein for rollably receiving the first end 77 of the axle 75 of the first roller means 71. The second block member 59 of the first frame 53 preferably has a notch 97 therein for rollably receiving the second end 79 of the axle 75 of the first roller means 71. The third block member 61 of the first frame 53 preferably has a notch 98 therein for rollably receiving the midportion of the axle 75 of the first roller means 71. The first block member 63 of the second frame 55 preferably has a notch 99 therein for rollably receiving the first end 87 of the axle 85 of the second roller means 73. The second block member 65 of the second frame 55 preferably has a notch 101 therein for rollably receiving the second end 89 of the axle 85 of the second roller means 73. The notches 95, 97, 99, 101 may be sized so as to closely fit the axles 75, 85 and promote resistance against enabling the board member 13 to merely be free to travel to-and-fro as it is being runningly ridably supported by the roller means 71, 73 in a manner and for reasons fully disclosed in the U.S. Pat. No. 4,324,399.

Figure 7:
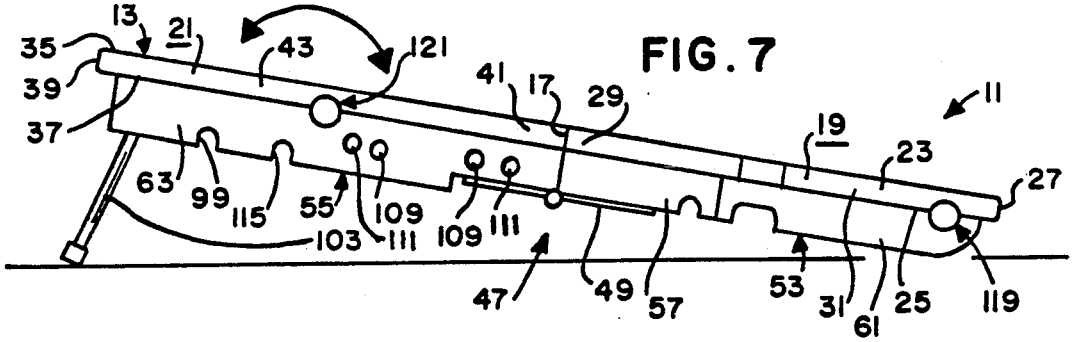

The device 11 preferably includes a first pair of legs 103 for allowing the board member 13 to be supported at a slant as shown in FIG. 7. Each leg 103 has a first end 105 for being attached to the board member 13 and a second end 107 for resting on the floor or other support surface. The device 11 preferably includes a second pair of legs 109 for allowing the board member 13 to be supported at a different slant from that dictated by the first pair of legs 103. More specifically, each leg 109 is preferably identical to the legs 103 except for the length thereof. Thus, the legs 103 may be approximately three times the length of the legs 109 to thereby cause the slant of the board member 13 to be different, depending on which set of legs 103, 109 is used as will now be apparent to those skilled in the art. The first and second block members 63, 65 of the second frame 55 preferably have one or more apertures 111 therein at the distal ends thereof for receiving the first ends 105 of the legs 103 or the legs 109. The distal end of the block member 61 is preferably rounded to allow the board member 13 to be supported in the slant position as shown in FIG. 7.

Figure 8:
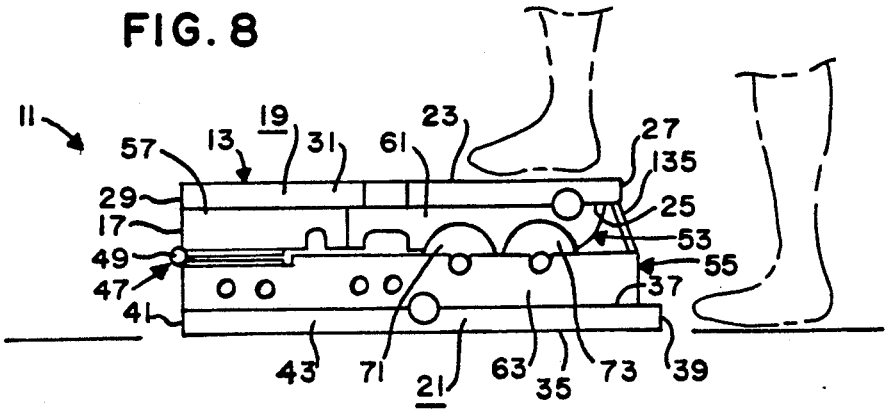
FIG. 8 is a side elevational view of the folding exercise device of the present invention shown in a third in-use position, i.e., for use as an aid for bench-stepping exercises and the like, with an exercises foot being shown in broken lines to diagrammatically shown the use of the exercise device of the present invention during bench-stepping exercises.

When the device 11 is in the folded position as shown in FIGS. 4 and 8, the first and second frames 53, 55 coact to form a storage area between the back surface 25 of the first end member 19 and the back surface 37 of the second end member 21 to allow various accessories to be stored therein. Thus, flexible weights 113 of the common type for being attached to an exerciser's wrists and ankles may be stored in the storage area as shown in FIG. 3. The first block member 63 of the second frame 55 preferably has a notch 115 therein for receiving the first end 77 of the axle 75 of the first roller means 71 and the second block member 65 of the second frame 55 preferably has a notch 117 therein for receiving the second end 79 of the axle 75 of the first roller means 71 when the device 11 is in the folded position. Apertures 119 are preferably provided through the sides of the block members 63, 65 for allowing the legs 103, 109 to extend therethrough to hold the legs 103, 109 when the legs 103, 109 are not being used to support the board member 13 at a slant. The device 11 is shown in a horizontal stored position in FIG. 4. However, it should be noted that the device 1 can be easily stored in a vertical position as will now be apparent to those skilled in the art.

The device 11 preferably includes a first transverse grip means 119 adjacent the first end of the board member 13 for assisting the exerciser in performing various specific exercises in conjunction with the device 11, and preferably includes a second transverse grip means 121 adjacent the second end of the board member 13 for assisting the exerciser in performing various specific exercises in conjunction with the device 11. The first transverse grip means 119 preferably includes an elongated bar 123 extending through and fixedly attached to the distal end of the third block member 61 of the first frame 53. The elongated bar 123 includes a first end 125 forming a first grip member on the first side 31 of the first end member 19, and a second end 127 forming a second grip member on the second side 33 of the first end member 19. The second transverse grip means 121 preferably includes an elongated bar 129 extending through and fixedly attached to the midportion of the first and second block members 63, 65 of the second frame 55. The elongated bar 129 includes a first end 131 forming a first grip member on the first side 43 of the second end member 21, and a second end 133 forming a second grip member on the second side 45 of the second end member 21.

The folding exercise device 11 preferably includes latch means 135 for securing the first and second end members 19, 21 in the folded position. The latch means 135 preferably includes a first latch member 137 fixedly attached to the distal end of the first end member 19 and a coacting second latch member 139 fixedly attached to the distal end of the second end member 21. The first and second latch members 137, 139 may consist of typical hook-and-eye type latch members as will now be apparent to those skilled in the art.

As thus constructed, the folding exercise device 11 allows an exerciser to perform all the specific exercises described in the U.S. Pat. No. 4,324,399 including rolling type exercises as shown diagrammatically in FIG. 6 with or without a track means as disclosed in the U.S. Pat. No. 4,324,399, and slant board type exercises as shown diagrammatically by the curved arrow in FIG. 7. In addition, with the device 11 in the folded position, the exerciser can perform step-up, step-down "bench-stepping" type exercises as shown diagrammatically in FIG. 8. The folding exercise device 11 offers several advantages over the exercise device disclosed in the U.S. Pat. No. 4,324,399 including:

1) portability,
2) can be stored in a minimum of floor space in either a horizontal position as shown in FIG. 4 or a vertical position,
3) provides storage space for auxiliary items such as combination dumb bell/rollers, ankle weights, wrist weights, shoes and/or foot weights, removable legs, etc.,
4) by folding the device, adequate and appropriate height is created so that it can be used for "bench-stepping" exercises.

Although the present invention has been described and illustrated with respect to a preferred embodiment and a preferred use therefor, it is not to be so limited since modifications and changes can be made therein which are within the full intended scope of the invention.

I claim:

1. An improved exercise device for exercising particular muscles of a user a the user selectively accomplishes various exercises in conjunction therewith, said exercise device comprising:

a) an oblong planar board member for supporting the user in any of several exercising positions, said board member including separate first and second end members; said first end member having a substantially planar face surface, a back surface, a distal end, a proximal end, a first side, and a second side; said second end member having a substantially planar face surface, a back surface, a distal end, a proximal end, a first side, and a second side;

b) a first frame fixedly attached to said back surface of said first end member; said first frame including an elongated first block member fixedly attached to said back surface of said first end member adjacent said first side thereof and extending from said proximal end of said first end member toward said distal end of said first end member, and an elongated second block member fixedly attached to said back surface of said first end member adjacent said second side thereof and extending from said proximal end of said first member toward said distal end of said first end member;

c) a second frame fixedly attached to said back surface of said second end member; said second frame including an elongated first block member fixedly attached to said back surface of said second end member adjacent said first side thereof and extending from said proximal end of said second end member toward said distal end of said second end member, and an elongated second block member fixedly attached to said back surface of said second end member adjacent said second side thereof and extending from said proximal end of said second end member toward said distal end of said second end member;

d) hinge means for hingably joining said first and second end members of said board member together and for allowing said board member to be folded between an opened position with said first and second end members of said board member forming a planar surface and a closed position; said hinge means including a first hinge member extending between said first block member of said first frame and said first block member of said second frame, and includes a second hinge member extending between said second block member of said first frame and said second block member of said second frame; and e) fore and aft roller means engaging said first and second frames for runningly ridably supporting said board member in a horizontal disposition.

2. The improvement of claim 1 in which each of said first and second block members of said first and second frames have bottom surfaces; in which said first hinge member has a first leaf for being attached to said bottom surface of said first block member of said first frame and has a second leaf for being attached to said bottom surface of said first block member of said second frame; and in which said second hinge member has a first leaf for being attached to said bottom surface of said second block member of said first frame and has a second leaf for being attached to said bottom surface of said second block member of said second frame.

3. The improvement of claim 1 in which each of said first and second block members of said first and second frames have proximal ends; in which said proximal end of said first block member of said first frame abuts said proximal end of said first block member of said second frame when said board member is in said opened position; and in which said proximal end of said second block member of said first frame abuts said proximal end of said second block member of said second frame when said board member is in said opened position.

4. The improvement of claim 1 in which said first frame includes an elongated third block member fixedly attached said first and second sides thereof and extending from said proximal end of said first end member toward said distal end of said first end member; in which said second frame includes an elongated third block member fixedly attached to said back surface of said second end member adjacent said distal end thereof and extending between said first and second block members of said second frame and an elongated fourth block member fixedly attached to said back surface of said second end member at a point between said distal and proximal ends thereof and extending between said first and second block members of said second frame for coacting with said first and second end members of said board member, said first, second and third block members of said first frame, and said first and second block members of said second frame to create a substantially closed, storage space between said first and second end members of said board member when said board member is in said closed position.

5. The improvement of claim 4 in which said third block member of said first frame has a distal end; in which said first and second block members of said second frame have midportions; in which is included a first transverse grip means for assisting an exerciser in performing various specific exercises in conjunction with said exercise device; and first transverse grip means including an elongated bar extending through and fixedly attached to said distal end of said third block member of said first frame; said elongated bar of said first transverse grip means including a first end forming a first grip member on said first side of said first end member of said board member and including a second end forming a second grip member on said second side of said first end member of said board member; and in which is included a second transverse grip means for assisting an exerciser in performing various specific exercises in conjunction with said exercise device; said second transverse grip means including an elongated bar extending through and fixedly attached to said midportion of said first and second block members of said second frame; said elongated bar of said second transverse grip member including a first end forming a first grip member on said first side of said second end member of said board member and including a second end forming a second grip member on said second side of said second end member of said board member.

6. An improved exercise device for exercising particular muscles of a user as the user selectively accomplishes various exercises in conjunction therewith, said exercise device comprising:

a) an oblong planar board member for supporting the user in any of several exercising positions, said board member including separate first and second end members; said first end member having a substantially planar face surface, a back surface, a distal end, a proximal end, a first side, and a second side; said second end member having a substantially planar face surface, a back surface, a distal end, a proximal end, a first side, and a second side;

b) a first frame fixedly attached to said back surface of said first end member; said first frame including an elongated first block member fixedly attached to said back surface of said first end member adjacent said first side thereof and extending from said proximal end of said first end member toward said distal end of said first end member, and an elongated second block member fixedly attached to said back surface of said first end member adjacent said second side thereof and extending from said proximal end of said first end member toward said distal end of said first end member; said first and second block members having bottom surfaces and proximal ends; said first frame including an elongated third block member fixedly attached to said back surface of said first end member intermediate said first and second sides thereof and extending from said proximal end of said first end member toward said distal end of said first end member; said third block member of said first frame having a distal end;

c) a second frame fixedly attached to said back surface of said second end member; said second frame including an elongated first block member fixedly attached to said back surface of said second end member adjacent said first side thereof and extending from said proximal end of said second end member toward said distal end of said second end member, and an elongated second block member fixedly attached to said back surface of said second end member adjacent said second side thereof and extending from said proximal end of said second end member toward said distal end of said second end member; said first and second block members having bottom surfaces, midportions and proximal ends; said second frame including an elongated third block member fixedly attached to said back surface of said second end member adjacent said distal end thereof and extending between said first and second block members of said second frame and an elongated fourth block member fixedly attached to said back surface of said second end member at a point between said distal and proximal ends thereof and extending between said first and second block members of said second frame;

d) hinge means for hingably joining said first and second end members of said board member together and for allowing said board member to be folded between an opened position with said first and second end members of said board member forming a planar surface an a closed position; said hinge means including a first hinge member extending between said first block member of said first frame and said first block member of said second frame, and includes a second hinge member extending between said second block member of said first frame and said second block member of said second frame; said first hinge member having a first leaf for being attached to said bottom surface of said first block member of said first frame and having a second leaf for being attached to said bottom surface of said first block member of said second frame; said second hinge member having a first leaf for being attached to said bottom surface of said second block member of said first frame and having a second leaf for being attached to said bottom surface of said second block member of said second frame; said proximal end of said first block member of said first frame abutting said proximal end of said first block member of said second frame when said board member is in said opened position; said proximal end of said second block member of said first frame abutting said proximal end of said second block member of said second frame when said board member is in said opened position; said first and second end members of said board member, said first, second and third block members of said first frame, and said first, second, third and fourth block members of said second frame coacting with one another to create a substantially closed, storage space between said first and second end members of said board member when said board member is in said closed position;

e) a first transverse grip means for assisting an exerciser in performing various specific exercises in conjunction with said exercise device; said first transverse grip means including an elongated bar extending through and fixedly attached to said distal end of said third block member of said first frame; said elongated bar of said first transverse grip means including a first end forming a first grip member on said first side of said first end member of said board member and including a second end forming a second grip member on said second side of said first end member of said board member;

f) a second transverse grip means for assisting an exerciser in performing various specific exercises in conjunction with said exercise device; said second transverse grip means including an elongated bar extending through and fixedly attached to said midportion of said first and second block members of said second frame; said elongated bar of said second transverse grip member including a first end forming a first grip member on said first side of said second end member of said board member and including a second end forming a second grip member on said second side of said second end member of said board member; and g) fore and aft roller means engaging said first and second frames for runningly ridably supporting said board member in a horizontal disposition.

* * * * *